US005901371A

United States Patent [19]

Lee

[11] Patent Number: 5,901,371

[45] Date of Patent: May 11, 1999

[54] CAP WITH ADJUSTABLE SIDE VISORS

[76] Inventor: Kun Yong Lee, 1167 W. Duarte Rd., Apt. #4, Arcadia, Calif. 91107

[21] Appl. No.: 09/098,158

[22] Filed: Jun. 16, 1998

[51] Int. Cl.[6] ..... A42B 1/06

[52] U.S. Cl. ..... 2/10; 2/172; 2/195.1

[58] Field of Search ..... 2/10, 172, 195.1, 2/195.2, 12, 15

*Primary Examiner*—Diana L. Biefeld

*Attorney, Agent, or Firm*—Oppenheimer Wolff & Donnelly LLP

[57] ABSTRACT

A cap with adjustable side visors is disclosed having a main body portion conforming to one's head, a rear adjustable strap and a forward extending curved main visor. A pair of spaced side visors are disposed on opposite sides of the main visor extending downwardly therefrom. Each side visor has a flap pivotally mounted thereto which is movable from a first position disposed within the respective side visor to a second position extending downwardly therefrom to vary the shading desired by the user.

9 Claims, 6 Drawing Sheets

FIG. 8
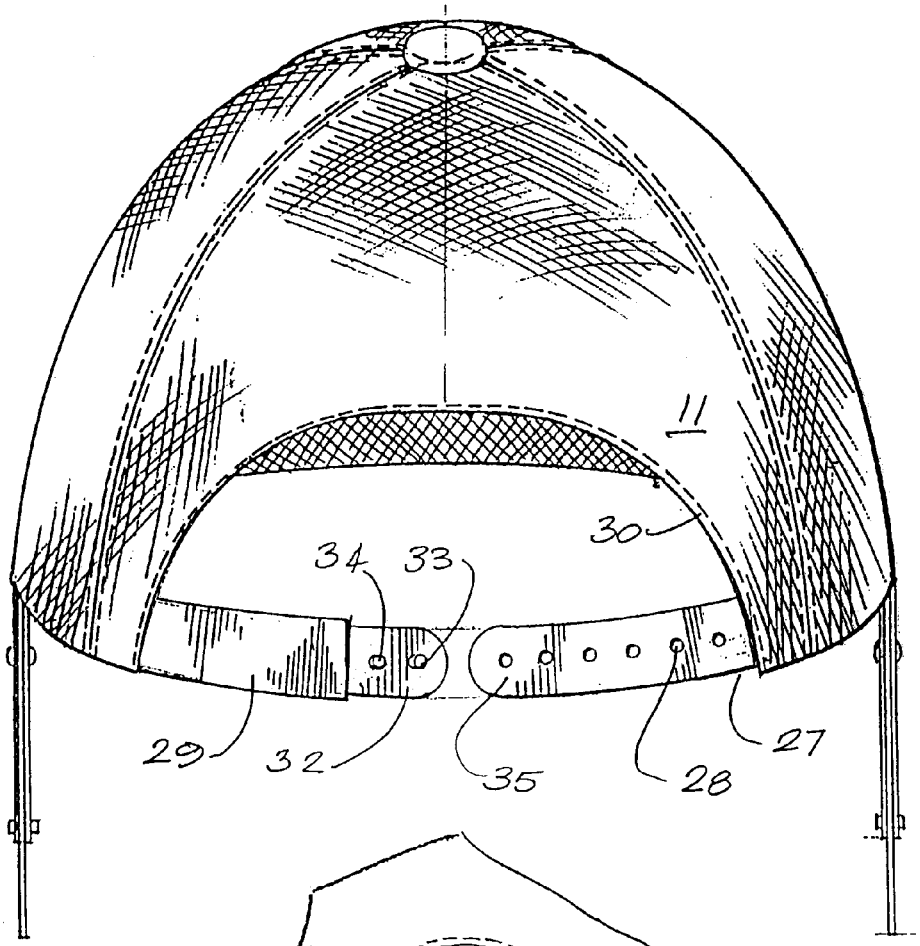
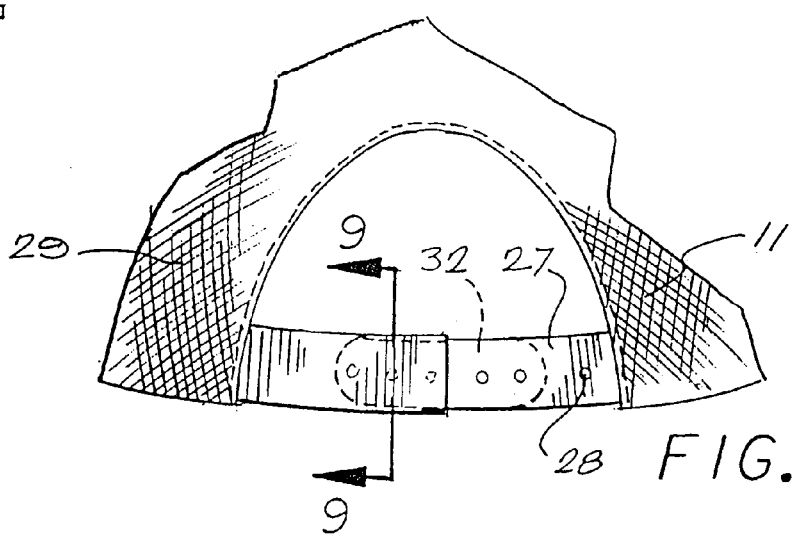
FIG. 7
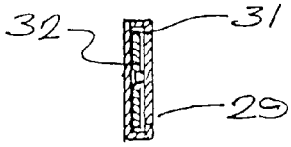
FIG. 9

CAP WITH ADJUSTABLE SIDE VISORS

BACKGROUND OF THE INVENTION

1. Field of the Invention

The invention relates to caps; and, more particularly, to caps having shades for blocking the sun.

2. Related Art

Caps are worn by many people, particularly those engaged in sports. Such caps have a strap or the like for adjusting the cap to one's head and a forwardly extending curved main visor, the latter blocking the sun so that the sun's glare won't affect the user's concentration in sports or the like. In some sports, such as golf, it is not easy to adjust one's position when addressing the golf ball. In such cases, the main visor may not be sufficient to block the sun. The golfer may put his or her hand up to the main visor shading the sun on one side or the other of the main visor.

In U.S. Pat. Nos. 4,839,924 and 4,321,709 hats are disclosed having flexible side visors associated with the main visor. In U.S. Pat. No. 5,007,110, a hat is disclosed with rigid side blinders which can be folded inwardly (FIG. 5). In U.S. Pat. No. 5,694,648, side flaps are provided on a hat.

However, although these patents recognize the shading problems with a conventional visored cap, none show added shading means associated with the side flaps for providing more shading on one or both sides of the cap.

There is thus a need for a visored cap having added shading means disposed on each side of the main visor for shading one's eyes from the sun.

SUMMARY OF THE INVENTION

It is an object of this invention to provide a visored cap having added shading means on each side of the main visor.

It is a further object of this invention to carry out the foregoing object wherein the added shading means pivot downwardly from side flaps then back upwardly to a stored position.

It is a further object of this invention to provide such a visored cup having a rear adjusting strap that is more secure than a conventional adjusting strap.

These and other objects are preferably accomplished by providing a cap having adjustable side visors with a main body portion conforming to one's head. A rear adjustable strap is provided as is a forward extending curved main visor. A pair of spaced side visors are disposed on opposite sides of the main visor extending downwardly therefrom. Each side visor has a flap pivotally mounted thereto which is movable from a first position disposed within the respective side visor to a second position extending downwardly therefrom to vary the shading desired by the user.

BRIEF DESCRIPTION OF THE DRAWING

FIG. 7 is a rear view of a portion of the cap of FIG. 1, disposed in an upside down position, illustrating the adjusting strap in a secured position;

FIG. 8 is a view, similar to FIG. 7, showing the strap portions in an unsecured position, and FIG. 9 is a view taken along lines 9—9 of FIG. 8.

DESCRIPTION OF THE PREFERRED EMBODIMENTS

Figure 1:
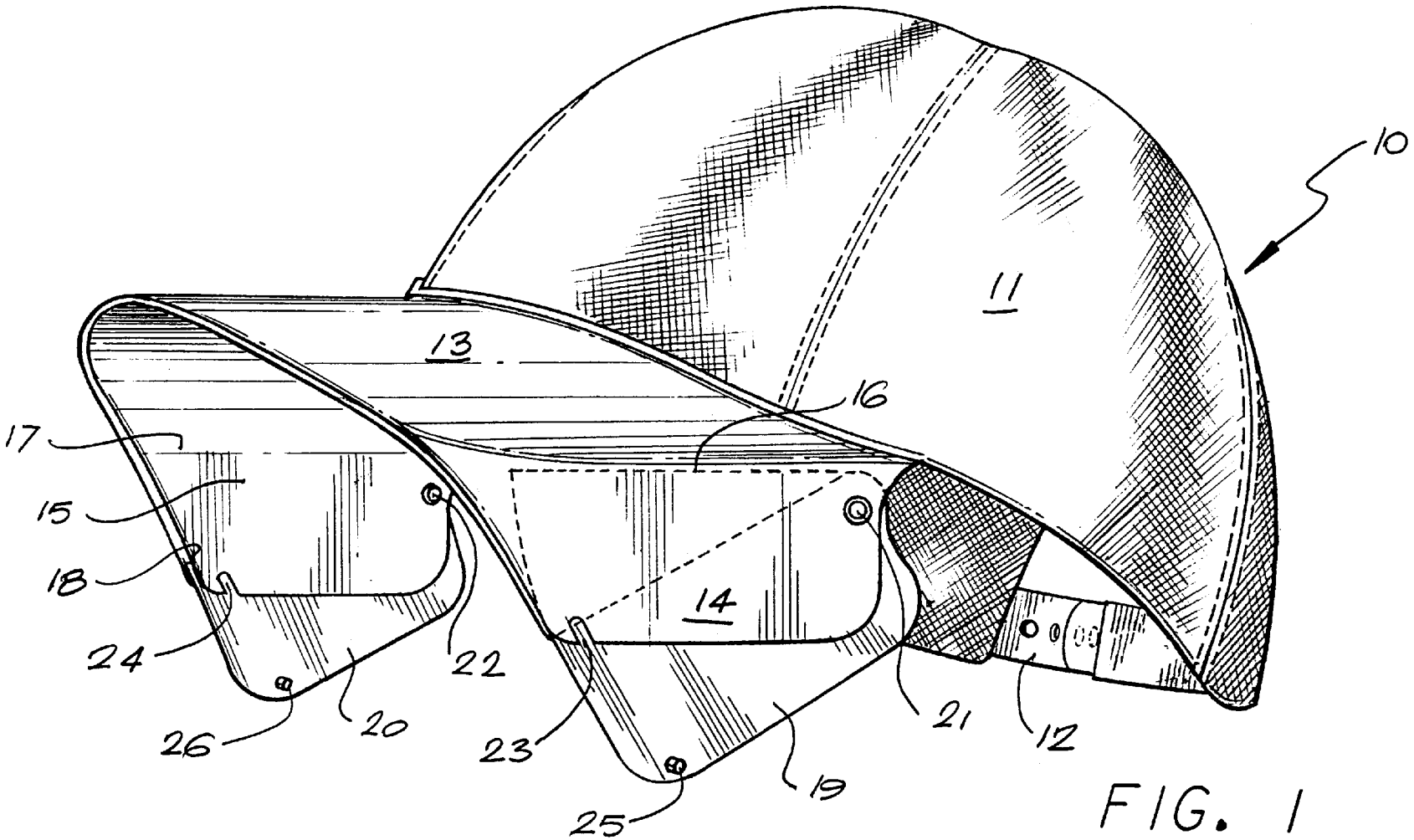
FIG. 1 is a front perspective view of a cap in accordance with the invention showing the adjustable flaps of the invention in a down operative position.

Referring now to FIG. 1 of the drawing, a cap 10 is shown having a main body portion 11 preferably of a flexible material, such as a cloth material, adapted to conform to the general shape of the head of a user. Cap 10 includes a rear adjustable strap portion 12, as will be discussed further, and an integral forwardly extending main visor 13, which may be curved in cross-section, and is generally of a rigid material, such as plastic.

Visor 13 has a pair of downwardly extending rigid side flaps 14, 15 secured to main visor 13 at edges 16, 17, respectively. Each side flap 14, 15 extends generally vertically downwardly and is slotted as seen at slot 18 in side flap 15 (see also FIG. 3 regarding flap 14).

Figure 2:
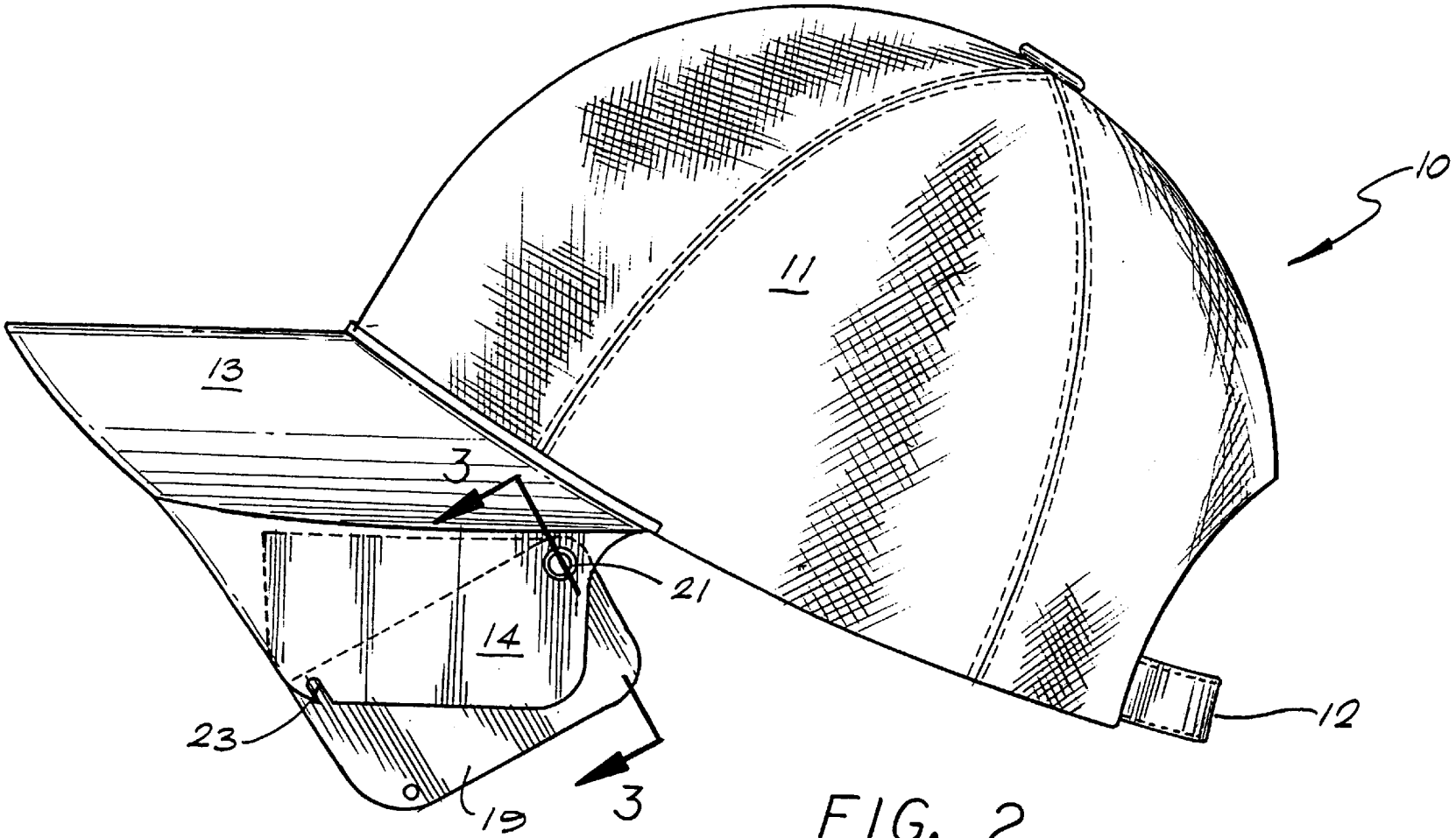
FIG. 2 is a side view of the hat of FIG. 1.
Figure 3:
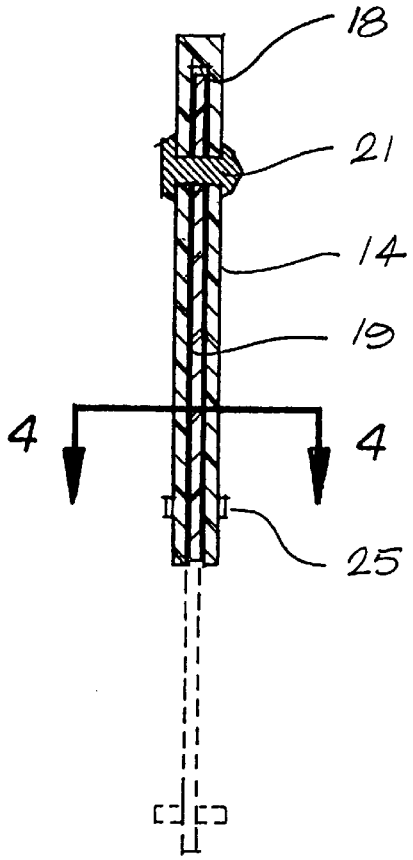
FIG. 3 is a view taken along lines 3—3 of FIG. 2.
Figure 4:
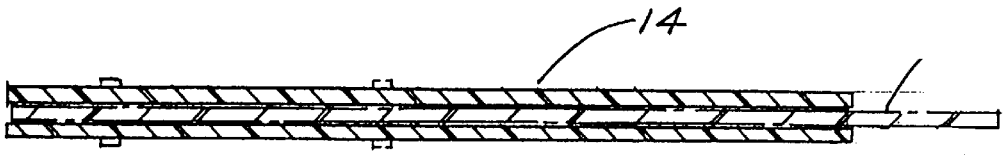
FIG. 4 is a view taken along lines 4—4 of FIG. 3.

As seen in FIGS. 1 and 2, each side flap 14, 15 has a movable flap extension as extensions 19, 20 respectively. Each flap extension (19, 20) is pivotally connected to its respective side flap at pivot pins 21, 22, respectively. Each side flap 14, 15 includes a slot at the forward end of the bottom thereof, such as slots 23, 24, respectively. As seen, these slots 23, 24 may be angled from the vertical and are aligned with a stop member, such as member 25, 26 on each respective flap extension 19, 20, receivable in slots 23, 24, respectively (when the flap extensions 19, 20 are pivoted from the downwardly extending position shown in FIGS. 1 and 2 to the upward or stored position shown in dotted lines in FIGS. 1 and 2). Thus, flap extensions 19, 20 are normally disposed within slots 18 in their respective side flaps 14, 15 until pulled down to the FIGS. 1 and 2 solid line positions. A user, such as a golfer, may pull down the flap extensions of the side flaps if he or she does not have sufficient shading when addressing a ball. After the golfer hits the ball, the flap extensions can be pivoted back up to the dotted line positions shown in FIGS. 1 and 2 when they are out of the way until needed again. A close fit may be provided between the thickness of the flap extensions 19, 20 and the inner width of slots 18 so that they are frictionally held within slots 18. This is shown in FIGS. 3 and 4 wherein flap extension 19 is disposed within slot 18 (solid line position in FIG. 3) after moving the same from the dotted line position.

Although any suitable strap adjustment may be used, I prefer to use an adjusting strap as shown in FIGS. 7 to 9. A first strap portion 27 extends from main body portion 11 sewn or otherwise fixed thereto having a plurality of spaced holes 28. A rectangularly shaped sheath portion 29 is fixed to body portion 11 opposite strap portion 27 both extending within a cutout area 30 of main body portion 11. Sheath 29, as seen in FIG. 9, has a rectangular open slot 31 with a strap receiving portion 32 (see also FIG. 8) fixedly secured therein and extending toward strap portion 27. Strap portion 32 has a plurality, such as 2, of spaced nubs 33, 34, receivable in holes 28 in strap portion 27. Thus, end 35 of strap portion 27 may be inserted into slot 31 with nubs 33, 34 entering holes 28 as seen in FIG. 7.

Figure 5:
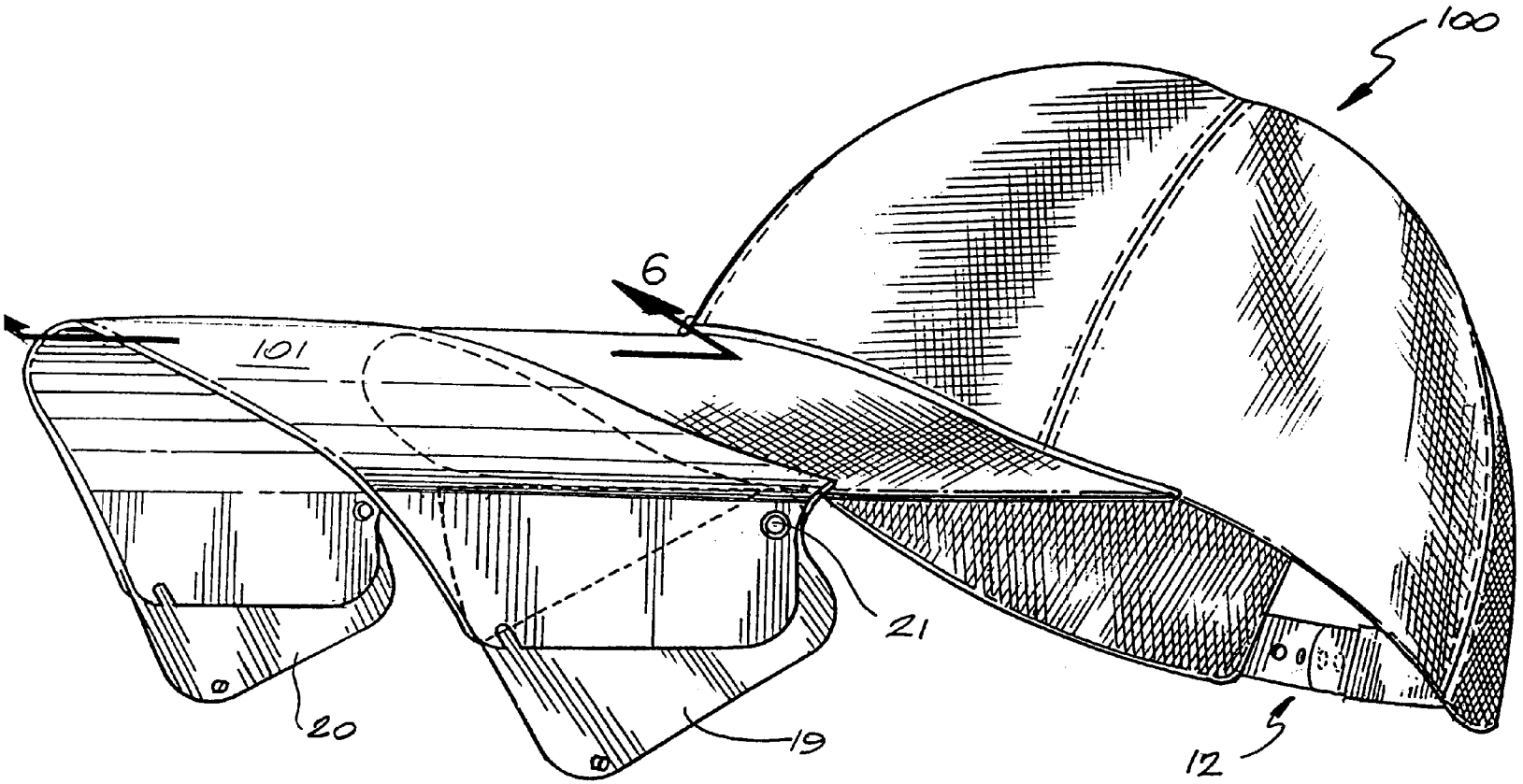
FIG. 5 is a view similar to FIG. 1 showing a modification of the hat of FIG. 1.
Figure 6:
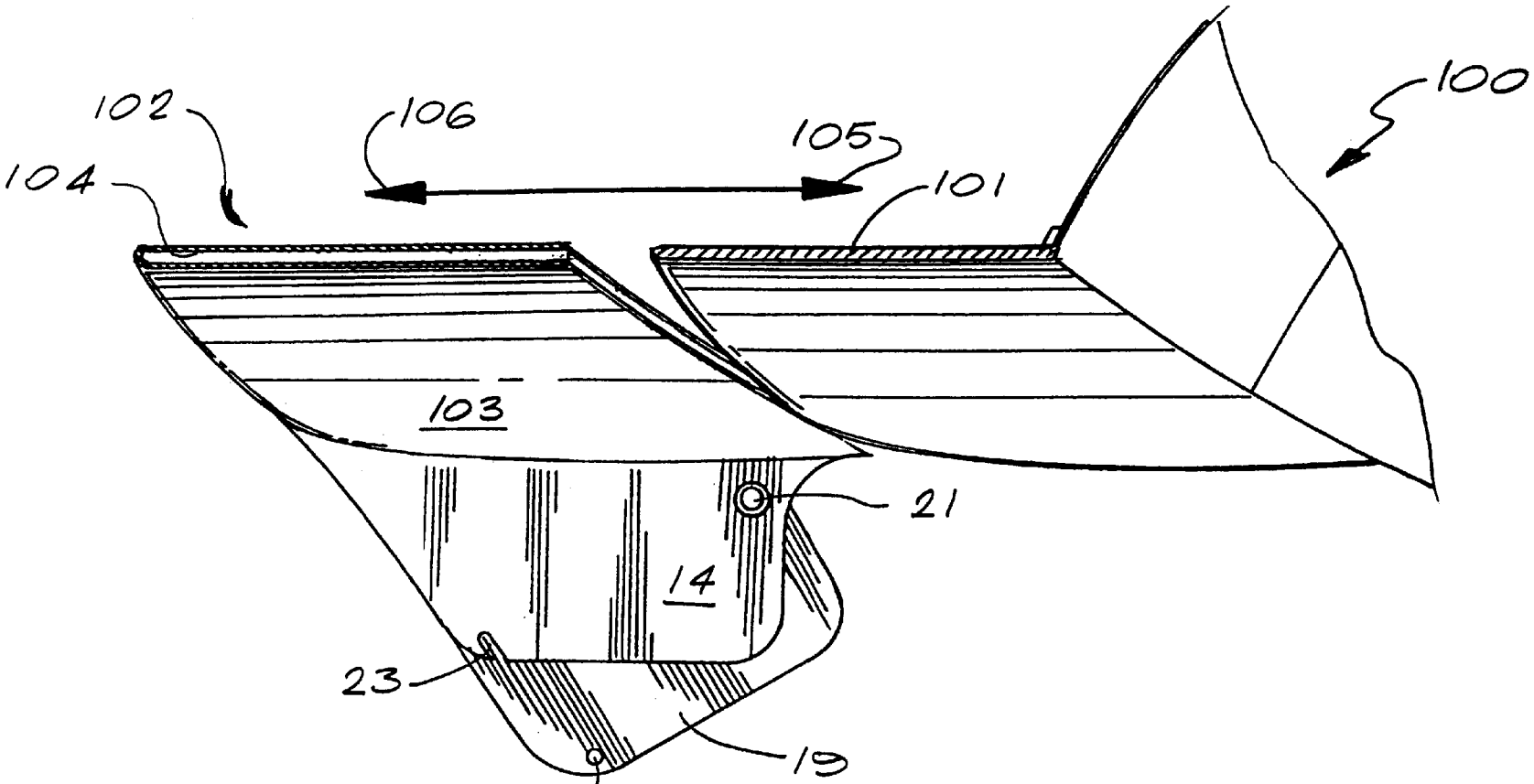
FIG. 6 is a side view, partly in section, of the cap of FIG. 5 having removable flaps.

As seen in FIG. 5, wherein like numerals refer to like parts of the cap of FIGS. 1 5, 4 and 6 to 9, cap 100 has a main visor 101, similar to visor 13, but does not have any side visors. The side visors are provided by a removable flap portion 102

(FIG. 6) having a slotted main body portion 103 with side flaps 14, 15 as previously discussed fixed thereto in the same manner as discussed with respect to FIGS. 1 to 4. The slot 104 in main body portion 103 is slightly greater in width than the thickness of main visor 101 and of a similar curvature so that it can be slid onto main visor 101 in the direction of arrow 105 or off in the direction of arrow 106 and retained thereon in a friction fit relationship. Thus, removable flap portion 102 can be mounted to any cap having a main visor similar to cap 100.

There is thus disclosed a unique and novel way for a user, such as a golfer, of providing added shading when required. Any suitable materials may be used such as plastic for the visor, the removable flap portion, the side flaps and extension portions, etc. Although a particular adjustment strap is disclosed, any suitable strap may be used such as a conventional hole and nub arrangement or mating strips of a hook and loop material. Although particular embodiments of the invention are disclosed, obvious variations may occur to an artisan and the scope of the invention should only be limited by the scope of the appended claims.

I claim:

1. In a cap having a main body portion conforming to the head of a wearer and a forwardly extending integral main visor, the improvement which comprises:

a pair of spaced side flaps extending downwardly on opposite sides of said main visor, each of said side flaps having extension portions associated therewith movable from a first position adjacent its respective side flap to a second position extending downwardly therefrom thereby providing added shade for a wearer, each of said side flaps having an internal slot, each of said extension portions being movably disposed within its respective slot.

2. The cap of claim 1 wherein each of said extension portions is pivotally connected to its respective side flap.

3. The cap of claim 2 wherein each of said extension portions has an abutment member at the lower end thereof receivable in a slot in the lower end of its respective side flap when moved from said second position back to said first position providing a stop for said side flaps.

4. The cap of claim 3 wherein each of said side flaps are planar and said extension portions frictionally fit within the respective slots in said side flaps and are planar and lie in a plane parallel to the plane of said side flaps.

5. The cap of claim 1 including an adjusting strap mounted on said cap rearwardly of said main visor.

6. The cap of claim 5 wherein said adjusting strap includes a first strap portion (35) having a plurality of spaced holes (28) therein receivable within a slot (31) in a second strap portion (29), said strap portion (29) being a sheath (29) having said rectangular open slot (31) leading therein, said second strap portion (29) having an extension portion (32) fixed thereto extending toward said first strap portion (35), said second strap portion extension portion (32) having at least one nub (33 or 34) receivable in one of said holes (28) in said first strap portion (35).

7. The cap of claim 6 wherein a plurality of spaced nubs are provided on said second strap extension portion and wherein said spaced nubs are receivable in said plurality of spaced holes in said first strap portion.

8. The cap of claim 1 wherein said side flaps are integral with said main visor extending generally vertically downwardly therefrom.

9. In a cap having a main body portion conforming to the head of a wearer and forwardly extending integral main visor, the improvement which comprises:

a pair of spaced side flaps extending downwardly on opposite sides of said main visor, each of said side flaps having extension portions associated therewith movable from a first position adjacent its respective side flap to a second position extending downwardly therefrom thereby providing added shade for a wearer, and a removable flap portion associated with said cap having a main body portion generally similar in cross-section to the cross-section of said main visor, said main body portion of said flap portion having said side flaps integral therewith and extending downwardly therefrom, said main visor being receivable in a slot within said main body portion of said removable flap portion and conforming thereto and frictionally fitting therein, whereby said removable flap portion can be mounted to said main visor or removed therefrom when desired.

* * * * *